US008842053B1

(12) United States Patent
Curtiss et al.

(10) Patent No.: US 8,842,053 B1
(45) Date of Patent: Sep. 23, 2014

(54) ELECTRICALLY SHORTENED YAGI HAVING IMPROVED PERFORMANCE

(75) Inventors: Clayton B. Curtiss, Lacey, WA (US); Michael E. Mertel, Medina, WA (US)

(73) Assignee: Fluidmotion, Inc., Bellevue, WA (US)

( * ) Notice: Subject to any disclaimer, the term of this patent is extended or adjusted under 35 U.S.C. 154(b) by 673 days.

(21) Appl. No.: 12/397,000

(22) Filed: Mar. 3, 2009

Related U.S. Application Data

(60) Provisional application No. 61/036,700, filed on Mar. 14, 2008.

(51) Int. Cl.
*H01Q 19/30* (2006.01)

(52) U.S. Cl.
USPC ..... 343/819; 343/878; 343/834; 343/833; 343/749; 343/745; 343/723

(58) Field of Classification Search
USPC ..... 343/819, 722, 723, 745, 749, 833, 834, 343/878
See application file for complete search history.

(56) References Cited

U.S. PATENT DOCUMENTS

| | | | | |
|---|---|---|---|---|
| 2,476,469 | A | 7/1949 | Walker | |
| 2,632,107 | A | 3/1953 | Hlilvjak | |
| 2,967,300 | A * | 1/1961 | Haughawout | 343/750 |
| 2,981,834 | A | 4/1961 | Holloway et al. | |
| 3,487,415 | A | 12/1969 | Simons | |
| 3,653,056 | A | 3/1972 | Peterson | |
| 3,683,391 | A | 8/1972 | Callaghan | |
| 3,931,626 | A | 1/1976 | Simons | |
| 3,971,031 | A | 7/1976 | Burke | |
| 4,028,709 | A | 6/1977 | Berkowitz et al. | |
| 4,145,694 | A | 3/1979 | Sletten | |
| 4,207,574 | A * | 6/1980 | Toia | 343/752 |
| 4,290,071 | A | 9/1981 | Fenwick | |
| 4,514,734 | A | 4/1985 | Cermignani et al. | |
| 4,604,628 | A | 8/1986 | Cox | |
| 4,785,308 | A | 11/1988 | Newcomb | |
| 5,061,944 | A | 10/1991 | Powers et al. | |
| 5,189,435 | A | 2/1993 | Yarsunas et al. | |
| 5,293,172 | A | 3/1994 | Lamberty et al. | |
| 5,841,406 | A | 11/1998 | Smith | |
| 5,865,390 | A | 2/1999 | Iveges | |
| 5,945,962 | A | 8/1999 | Harrington et al. | |
| 5,995,061 | A * | 11/1999 | Schiller | 343/815 |
| 6,107,969 | A | 8/2000 | Gulino et al. | |

(Continued)

FOREIGN PATENT DOCUMENTS

WO 2008/112486 A1 9/2008

OTHER PUBLICATIONS

Antenna Standards Committee, "IEEE Standard Definitions of Terms for Antennas.," IEEE Std 145-1993 , vol., No., pp. i, 1993, found at: http://ieeexplore.ieee.org/stamp/stamp.jsp?tp=&arnumber=286098&isnumber=7109.*

Viebicke, Yagi Antenna Design, Dec. 1976, NIST.*

(Continued)

*Primary Examiner* — Jacob Y Choi
*Assistant Examiner* — Jae Kim
(74) *Attorney, Agent, or Firm* — The Webb Law Firm

(57) ABSTRACT

An electrically-shortened Yagi antenna includes a boom, a first electrically-shortened end element mounted on the boom, a second electrically-shortened end element mounted on the boom; and an electrically-shortened driven element mounted on the boom and electrically shortened less than the first and second electrically-shortened end elements.

14 Claims, 2 Drawing Sheets

(56) References Cited

U.S. PATENT DOCUMENTS

| | | | | |
|---|---|---|---|---|
| 6,154,180 | A | 11/2000 | Padrick | |
| 6,239,760 | B1 * | 5/2001 | Van Voorhies | 343/742 |
| 6,300,912 | B1 | 10/2001 | Pla | |
| 6,323,821 | B1 | 11/2001 | McLean | |
| 6,337,667 | B1 * | 1/2002 | Ayala et al. | 343/795 |
| 6,469,674 | B1 * | 10/2002 | Podger | 343/742 |
| 6,677,914 | B2 | 1/2004 | Mertel | |
| 6,839,038 | B2 * | 1/2005 | Weinstein | 343/795 |
| 6,856,296 | B1 * | 2/2005 | Slay | 343/715 |
| 7,205,953 | B2 | 4/2007 | Knadle et al. | |
| 7,388,555 | B1 | 6/2008 | Mertel | |
| 7,463,211 | B2 | 12/2008 | Mertel et al. | |
| 2002/0171598 | A1 * | 11/2002 | Mertel | 343/818 |
| 2003/0013408 | A1 * | 1/2003 | Blodgett et al. | 455/3.01 |
| 2005/0237256 | A1 | 10/2005 | Regala | |
| 2007/0229386 | A1 * | 10/2007 | Mertel et al. | 343/823 |

OTHER PUBLICATIONS

Written Opinion dated May 25, 2008 in International Patent Application No. PCT/US08/56019 filed Mar. 6, 2008, 3 pages.

International Preliminary Report on Patentability dated Sep. 15, 2009 in International Patent Application No. PCT/US08/56019 filed Mar. 6, 2008, 4 pages.

Gibson, William, "A Teletuned 10 Meter Beam," QST, Cover page and p. 35, Aug. 1952.

Advertisement for "Cliff-Dweller" by New-Tronics, Model CD 40-75, QST, p. 138, Dec. 1964.

* cited by examiner

ELECTRICALLY SHORTENED YAGI HAVING IMPROVED PERFORMANCE

CROSS-REFERENCE TO RELATED APPLICATIONS

This application claims priority to U.S. Provisional Patent Application Ser. No. 61/036,700, filed Mar. 14, 2008, the entirety of which is incorporated by reference herein.

BACKGROUND

1. Field of the Invention

The present invention relates to radio-frequency antennas. More particularly, the present invention relates to multi-element Yagi antennas and to such antennas having electrically-shortened elements.

2. The Prior Art

Yagi antennas are known in the art. A typical prior-art 3-element Yagi antenna is depicted in FIG. 1. The rear element, known as the reflector, is longer than the center driven element. The front element, known as the director, is shorter than the driven element and the reflector.

Electrically-shortened Yagi antennas are known in the art. Electrically shortening the elements allows them to be physically shorter but still resonate at the desired frequency. Among the advantages obtained by shortening the elements is the reduction of the turning radius of the antenna.

Shortened Yagi antennas are useful in applications where the physical size of a full-sized Yagi would not be practical or possible. When a Yagi antenna is constructed exclusively with elements shorter than full length, its performance is degraded. This degradation is directly proportional to the degree of the reduction in physical length. The more the elements are electrically shortened, the more performance is degraded. Because of this, conventional design practice dictates keeping all of the elements as long as possible to preserve performance characteristics.

BRIEF DESCRIPTION

According to the present invention, it has been shown that by physically lengthening the element that is in the middle of an electrically-shortened three element Yagi, for example, less electrical shortening of that element is necessary and the effect is nearly the same as physically lengthening all three elements by the same amount. If a Yagi has more than three elements, physically lengthening all of the middle elements yields the same advantage. Making the middle element(s) less shortened with respect to the outer two elements improves the coupling to each of the electrically shorter elements to a very large degree.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

According to one aspect of the present invention, an electrically-shortened Yagi antenna includes a first end element electrically shortened, a second end element electrically shortened, and a driven element electrically shortened less than the first and second end elements. Electrical shortening of the elements can be accomplished using loading coils, linear loading via capacitive hats, and by looping the elements as shown in FIG. 2.

Figure 1:
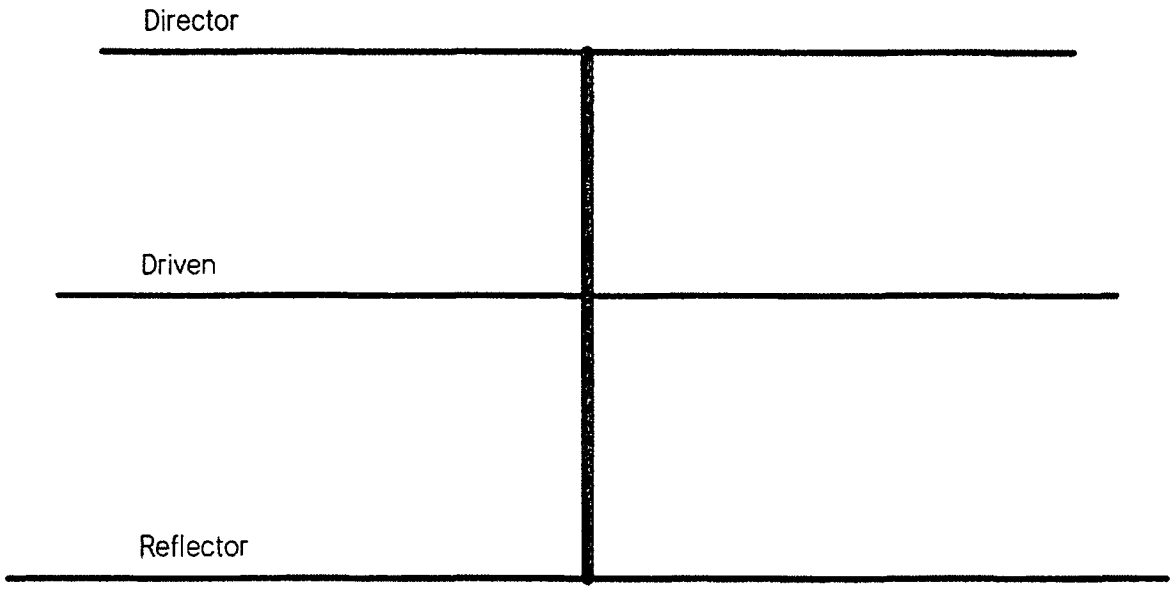
FIG. 1 is a top view of a prior-art Yagi antenna.
Figure 2:
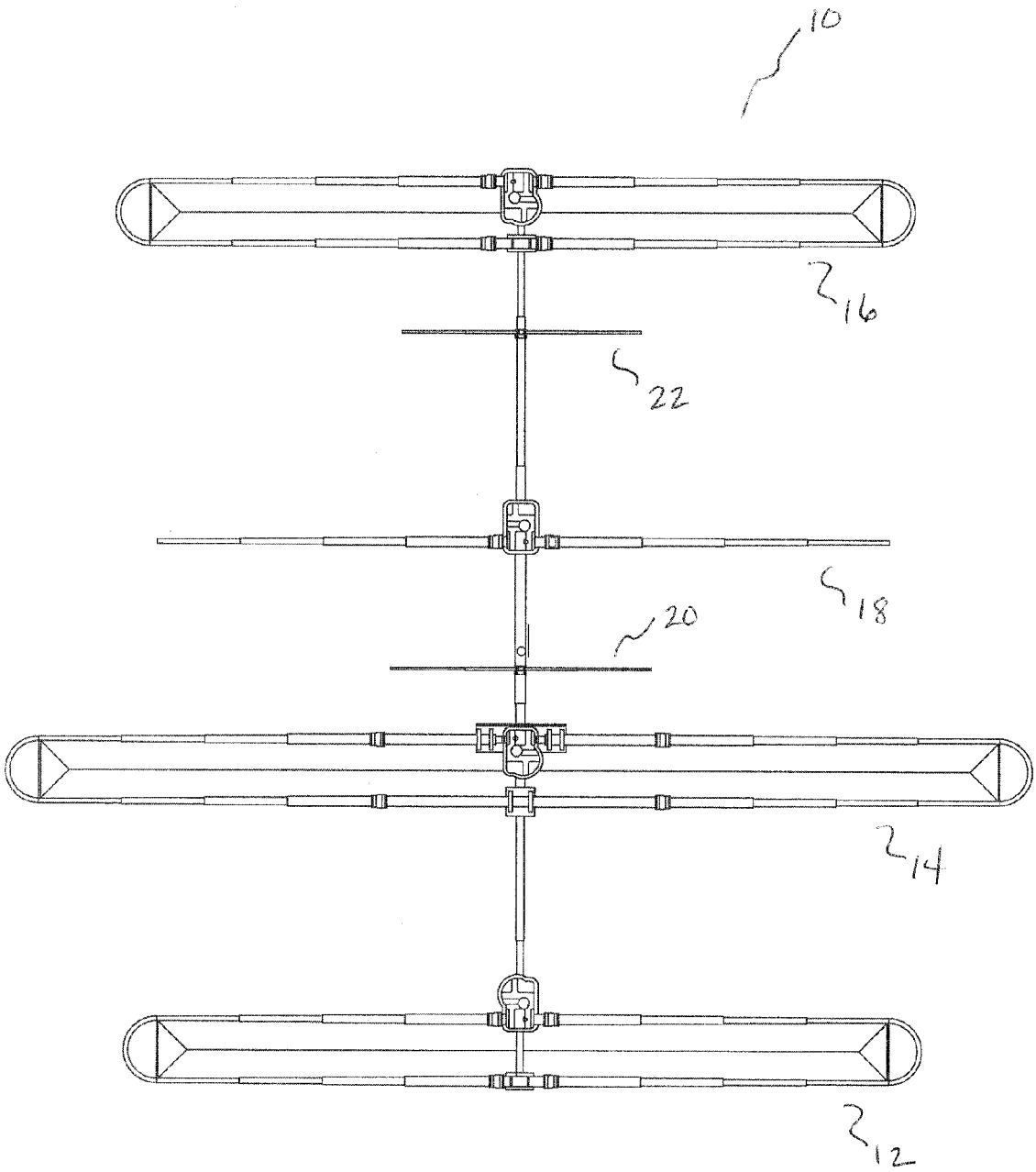
FIG. 2 is a top view of an electrically-shortened Yagi antenna constructed in accordance with the principles of the present invention.

Referring now to FIG. 2, an example of an electrically-shortened Yagi 10 is shown. The Yagi antenna of FIG. 2 is a 3-element example and includes reflector 12, driven element 14, and director 16. A non-looped director 18 is also shown, but this element is not-electrically shortened according to the principles of the present invention. Parasitic elements 20 and 22 are also shown. The antenna depicted in FIG. 2 is an example of an adjustable frequency Yagi, such as those manufactured by Steppir Antennas, Inc., of Bellevue, Wash. Such antennas employ hollow element support arms into which adjustable elements may be introduced to controlled lengths to resonate over a range of different frequencies and are described in U.S. Pat. Nos. 6,677,914 and 7,463,211. The looped configuration of the reflector, director, and driven element provide capacitive loading at lengths beyond which the elements reverse direction in the support arms. Until the driven element and the reflector and director reverse directions, the antenna acts as a full sized Yagi, and becomes an electrically-shortened Yagi after the driven element and the reflector and director elements reverse directions within the support arms and become capacitively loaded elements.

As can be seen from an examination of FIG. 2, the physically longest element in the antenna is driven element 14. Reflector 12 and director 16 may be made the same length, which is shorter than driven element 12. The elements are at their longest when extended into the support arms at the ends of their travel in the reverse direction back towards the boom.

While FIG. 2 shows a particular embodiment of the invention, the principles of the invention apply to fixed-frequency Yagis having fixed-length elements that are electrically-shortened by using loading coils, linear loading via capacitive hats, and other inductive and capacitive loading techniques.

According to another aspect of the present invention, an electrically-shortened multi-element Yagi has more than three elements. A first end element is electrically shortened by a first factor, a second end element is electrically shortened by the first factor, a driven element and other non-end elements are electrically shortened by a second factor less than the first factor.

Field testing and computer modeling has shown that the effect is close to what can be achieved by making all three elements longer, and is within 0.2 dB of the performance of a full-sized antenna. An additional advantage of antennas constructed in accordance with the present invention is that making only the middle element of an electrically shortened Yagi longer does not increase the turning radius of the antenna, thereby allowing the antenna to be erected in the same sized space as an antenna with all shortened elements and in a significantly smaller space than a full-sized antenna.

Included below are three sets of examples of three-element electrically shortened Yagi antennas whose performance characteristics are then compared to full-sized a Yagi with identical boom length and element spacing, and other electrically-shortened Yagis.

Example 1

A three-element 40M (7.2 MHz) antenna has electrically-shortened elements that use linear loading at the element ends (full-sized elements are approximately 66 to 68 feet long for comparison). The boom is 42 feet long and the center element is placed 200 inches from the reflector.

In Case 1, all three elements are electrically shortened by 40%. In Case 2, all three elements are shortened by 25%. In Case 3, the center element is shortened by 25% and the remaining two elements are shortened by 40%. In Case 4, all elements are full sized Table 1 summarizes the gain (in freespace) and front-to-back ratio for the four cases.

TABLE 1

| | Case 1 | Case 2 | Case 3 | Case 4 |
|---|---|---|---|---|
| Shortening | All 40% | All 25% | Center 25%<br>Ends 40% | Full Size |
| Gain | 7.0 dBi | 8.11 dBi | 8.14 dBi | 8.20 dBi |
| Front-to-Back | 21 dB | 27.1 dB | 25 dB | 25 dB |

From table 1, it may be seen that in Case 3, where the center element is shortened by 25% and the remaining two elements are shortened by 40%, the gain of the antenna is within 0.06 dB of that of the full-sized Yagi.

Example 2

A three-element 40M (7.2 MHz) antenna has shortened elements that use inductive loading at the element centers. The boom is 42 feet long and the center element is placed 200 inches from the reflector. All inductors are assumed to have a Q of 500 and the resistive losses of the inductors are included in the gain figures.

In Case 1, all of the elements are shortened at least 48%, and the center element is loaded with 32 micro-Henry inductors (1450 ohms of reactance). In case 2, the center element is shortened by 25% and the remaining two elements are shortened at least by 48%. The center element is center loaded with a 14 micro-Henry inductor (635 ohms of reactance) and the two outer elements are center loaded with 32 micro-Henry inductors (1,450 ohms of reactance). In Case 3, all of the elements are shortened by approximately 25%, and the center element is loaded with 16 micro-Henry inductors (725 ohms of reactance).

Table 2 summarizes the gain (in freespace) and front-to-back ratio for the four cases.

TABLE 2

| | Case 1 | Case 2 | Case 3 |
|---|---|---|---|
| Shortening | All 48% | Center 25%<br>Ends 48% | All 25% |
| Loading | Center 32 μH | Center 14 μH<br>Ends 32 μH | Center 16 μH |
| Gain | 5.69 dBi | 7.14 dBi | 7.33 dBi |
| Front-to-Back | 19 dB | 25 dB | 28 dBi |

Example 3

A 6M (50.0 MHz) three-element antenna has three electrically-shortened elements that use linear loading at the element ends. The boom is 6 feet long and the center element is placed 33 inches from the reflector.

In Case 1, all of the elements are electrically shortened 43%. In Case 2, all of the elements are shortened by 22%. In Case 3, the center element is shortened by 22% and the remaining two elements are shortened by 43%. In Case 4, all of the elements are full sized. Table 3 summarizes the gain (in freespace) and front-to-back ratio for the four cases.

TABLE 3

| | Case 1 | Case 2 | Case 3 | Case 4 |
|---|---|---|---|---|
| Shortening | All 43% | All 22% | Center 22%<br>Ends 43% | Full Size |
| Gain | 6.64 dBi | 8.19 dBi | 8.25 dBi | 8.37 dBi |
| Front-to-Back | 17 dB | 25 dB | 30 dB | 25 dB |

As can be seen in the above three examples, increasing the length of only the center element results in a gain increase of 1.14 to 1.6 dB and front-to-rear pattern improvement of 4 to 13 dB, depending on the element spacing and length of the shortened elements and the loading technique employed.

Additionally, the gain of the antenna is within 0.2 dB of a full-sized antenna and exhibits equal or better front-to-rear performance. In all three examples, the turning radius of the antenna does not increase so the smaller physical space requirements for installation of a shortened element antenna are maintained.

There are numerous applications of the electrically-shortened Yagi antenna of the present invention. Several exemplary applications of the present invention include, but are not limited to, transmitting and/or receiving Yagi antennas for high frequency applications below 14 MHz where the very large physical size often makes a full-sized Yagi impossible or impractical. In addition, antennas constructed according to the present invention are useful for high frequency applications between 14 and 30 MHz where restricted available space makes conventional full-sized antennas impossible or impractical.

Antennas constructed according to the present invention are also useful for VHF applications, especially for portable or emergency use, where a full-sized antenna, although not necessarily large in the usual sense of the word, may be difficult to transport on public, private or remote road systems, and for UHF and microwave Yagi antennas, especially those embedded in small or hand-held portable devices that may require directivity and gain and that may be attached to the case of the device or realized on a printed-circuit board or otherwise contained within the device. Antennas constructed according to the present invention are also useful for reception of ATSC digital television, FM radio, wireless networking or other radio communications either as a passive antenna or in combination with active electronic devices to further enhance reception.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed for carrying out this invention, but that the invention will include all embodiments falling within the scope of the appended claims.

What is claimed is:

1. An electrically-shortened Yagi antenna including:

a boom;

a reflector end element electrically shortened with reference to a full sized reflector element mounted on the boom;

a director end element electrically shortened with reference to a full sized director element mounted on the boom; and a driven element electrically shortened with reference to a full sized driven element mounted on the boom and electrically shortened in an amount less than the electrically-shortened end reflector and director elements.

2. The electrically-shortened Yagi antenna of claim 1 wherein the electrically-shortened end reflector and director elements are shortened by a first factor and the electrically-shortened driven element is shortened by a second factor less than the first factor.

3. The electrically-shortened Yagi antenna of claim 1 wherein the electrically-shortened reflector and director elements and the electrically-shortened driven element are electrically shortened using one of loading coils, linear loading via capacitive hats, and looping the elements.

4. The electrically-shortened Yagi antenna of claim 2, further including at least one electrically-shortened passive element mounted on the boom and disposed between the driven element and the reflector element, the at least one electrically-shortened passive element shortened less than the electrically-shortened end reflector and director elements.

5. The electrically-shortened Yagi antenna of claim 4, wherein the at least one electrically-shortened passive element is shortened by the second factor.

6. The electrically-shortened Yagi antenna of claim 4, wherein the at least one electrically-shortened element is electrically shortened using one of loading coils, linear loading via capacitive hats, and looping the elements.

7. An electrically-shortened Yagi antenna including:

a boom;

a first passive end element electrically shortened with reference to a full sized passive element mounted on the boom at a first end thereof;

a second passive end element electrically shortened with reference to a full sized passive element mounted on the boom at a second end thereof; and a driven element electrically shortened with reference to a full sized driven element mounted on the boom and spaced apart from the first and second passive elements, the electrically shortened driven element electrically shortened by an amount less than the first and second electrically-shortened end elements.

8. The electrically-shortened Yagi antenna of claim 7 wherein the first and second electrically-shortened passive end elements are shortened by a first factor and the electrically-shortened driven element is shortened by a second factor less than the first factor.

9. The electrically-shortened Yagi antenna of claim 7 wherein the first and second electrically-shortened passive elements and the electrically-shortened driven element are electrically shortened using one of loading coils, linear loading via capacitive hats, and looping the elements.

10. The electrically-shortened Yagi antenna of claim 8, further including at least one electrically-shortened passive element mounted on the boom and disposed between the driven element and the first electrically-shortened passive end element, the at least one electrically-shortened passive element shortened less than the first and second electrically-shortened passive end elements.

11. The electrically-shortened Yagi antenna of claim 10, wherein the at least one electrically-shortened passive element is shortened by the second factor.

12. The electrically-shortened Yagi antenna of claim 10, wherein the at least one electrically-shortened passive element is electrically shortened using one of loading coils, linear loading via capacitive hats, and looping the elements.

13. The electrically-shortened Yagi antenna of claim 7 wherein:

the first electrically-shortened passive end element is a director; and the first electrically-shortened passive end element is a reflector.

14. The electrically-shortened Yagi antenna of claim 10 wherein:

the first electrically-shortened passive end element is a first director;

the first electrically-shortened passive end element is a reflector; and the at least one electrically-shortened passive element mounted on the boom and disposed between the driven element and the first electrically-shortened passive end element is an additional director.

* * * * *